United States Patent [19]

Tomac

[11] Patent Number: 4,607,502

[45] Date of Patent: Aug. 26, 1986

[54] DEVICE FOR COOLING CONTAINERS, FOR INSTANCE BEVERAGE BOTTLES OR BEVERAGE CANS, ARRANGED IN A WRAPPING

[76] Inventor: Zeljko Tomac, Moritzstr. 3, 6200 Wiesbaden, Fed. Rep. of Germany

[21] Appl. No.: 616,558

[22] Filed: Jun. 1, 1984

[30] Foreign Application Priority Data

Jun. 3, 1983 [DE] Fed. Rep. of Germany ..... 3320243

[51] Int. Cl.[4] ..... F25D 3/10

[52] U.S. Cl. ..... 62/294; 62/372; 62/457; 62/530

[58] Field of Search ..... 62/457, 372, 530, 294

[56] References Cited

U.S. PATENT DOCUMENTS

| | | | |
|---|---|---|---|
| 2,137,705 | 11/1938 | Tiefry | 62/457 X |
| 2,154,933 | 4/1939 | Hadsell | 62/530 |
| 2,844,299 | 7/1958 | Kessler et al. | 62/457 |
| 2,979,227 | 4/1961 | Norton et al. | 62/457 X |
| 3,298,194 | 1/1967 | Hutchinson | 62/294 |
| 4,126,016 | 11/1978 | Greiner | 62/294 X |

*Primary Examiner*—Lloyd L. King
*Attorney, Agent, or Firm*—Karl F. Ross

[57] ABSTRACT

A device for cooling containers, for instance beverage bottles or beverage cans, arranged in a wrapping comprises a cooling-medium receptacle inserted or insertable within the wrapping, between the containers to be cooled, said receptacle being brought in surface contact with certain areas of the peripheral surface of the containers, due to a predetermined or bag-like shape. The components of a cooling mix have to be placed in the cooling-medium receptacle. The cooling-medium receptacle meant for one-time use and already containing the stable components, for instance the solid components, of the cooling mix is preferred. The cooling-medium receptacle prepared as mentioned can be placed in advance in a commercial package for filled containers, for instance beverage bottles or beverage cans. Before the use of the containers respectively the consumption of the beverages, it is required to add the reactive components after opening the package and then to reclose the cooling-medium receptacle. The shape and the dimensions of the cooling-medium receptacle can be adjusted to the type and the dimensions of the container package, for instance cardboard packages and portable packages.

11 Claims, 8 Drawing Figures

DEVICE FOR COOLING CONTAINERS, FOR INSTANCE BEVERAGE BOTTLES OR BEVERAGE CANS, ARRANGED IN A WRAPPING

FIELD OF THE INVENTION

The invention relates to a device for cooling filled containers, for instance beverage bottles or beverage cans in a wrapping or multiple-container carrier.

BACKGROUND OF THE INVENTION

A tempering element is known from German Utility Model No. 82 16 051 according to which a cooling mixture is fed into the element mounted between the goods to be cooled inside a cooling box or the like. This tempering element is particularly advantageous and suited for repeated use and is as a result relatively difficult to build and equip.

OBJECT OF THE INVENTION

The object of this invention is to provide a particularly simple and inexpensive cooling device, which can be used in cooperation with a wrapping, namely the packaging of the goods itself.

SUMMARY OF THE INVENTION

This object is attained, according to the invention, with a tightly closable receptacle for a cooling medium inside the package, insertable or mountable between the containers to be cooled and in surfaces contact with the surrounding surface of the containers; the interior of the receptacle receives at least one lasting component of a cooling mixture before use. The walls of said receptacle have at least one tightly closable filling opening to receive the reactive component or reactive components of the cooling mix.

This cooling device can be built relatively simple and for a one-time use. Thus, it can be manufactured at low cost. In addition, this cooling device can be adjusted to each type of container packaging, for instance beverage bottles, resulting in an optimal cooling efficiency.

In an embodiment of the invention, the receptacle for the cooling medium is shaped for insertion between the neck areas of the bottles inserted in an upright package. In this case the bottles can still be tightly arranged in the upright package, leaving enough room for the cooling-medium receptacle between the bottles in the upright package, in order to enable said receptacle to receive sufficient amounts of cooling mixture for the desired cooling. In this case, the filling opening will be advantageously mounted at the cover of the cooling-medium receptacle, arranged to follow the side of the bottle opening. It is especially advantageous in this embodiment of the invention to provide in addition a locking plate ensuring that the bottles inserted in the upright pack are kept together in surface contact with the cooling-medium receptacle, said plate being designed to simultaneously grip the neck area of the bottles joined in the upright pack, via an arrangement of perforations. The locking plate can be tightly connected or tightly connectable with the cover wall of the cooling-medium receptacle.

In another embodiment of the invention, the cooling-medium receptacle is built with at least one wall portion as a support for the bottom areas of a plurality of packed containers. Advantageously, for this purpose the cooling receptacle has two wall portions opposite to each other, each serving to support the bottom areas of a plurality of packed containers. In this embodiment, the device according to the invention is especially suited for horizontal packing of bottles or cans, whereby the cooling-medium receptacle can be arranged between the bottoms opposite to each other of the bottles, or cans. The wrapping can be for instance the cardboard multi-container pack commonly found on the market. It is especially advantageous for each of the embodiments of the invention to mount the filling opening generally in the deepest spot of a trough-shaped recessed wall portion at the upper side of the cooling medium receptacle. The feeding of the reaction component, or reaction components can take place easily, without requiring that the cooling-medium receptacle, previously inserted between the packed containers, be taken out.

Since the wrapping and packed containers in general form of rigid unit, it is possible with the invention to construct a cooling-medium receptacle which is particularly thin-walled and of light weight. It is especially advantageous to shape the cooling-medium receptacle as a bag.

Because in most cases such cooling mixtures are provided wherein water is fed as a reaction component, it is recommended to make the filling opening as a sieve- or filer element, or to mount a sieve or filter element in the filling opening. Thereby the water to be used as a reaction component can be drawn without problems from any body of water and fed into the cooling-medium receptacle.

The device according to the invention can contain in addition a housing of thermoinsulating material, for instance a plastic foam, designed to receive the entire wrapping with the containers to be cooled and the cooling-medium receptacle.

But it is also possible within the framework of the invention to provide a circumferentially closable wrapping container made of thermoinsulating material, for instance a plastic foam, designed for the insertion of the containers to be cooled and the cooling-medium receptacle.

BRIEF DESCRIPTION OF THE DRAWING

Embodiments of the invention are further clarified with the aid of the drawing in which.

SPECIFIC DESCRIPTION

Figure 1:
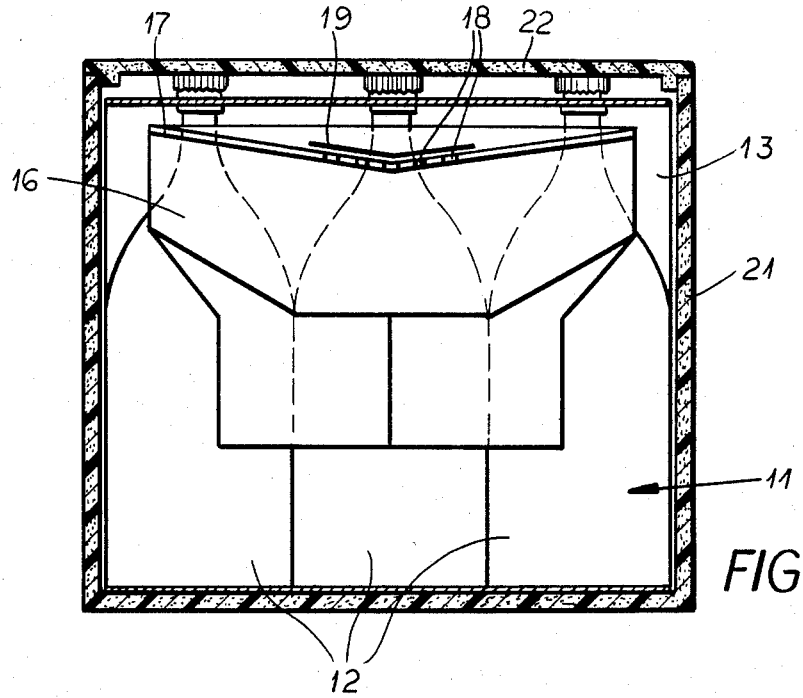
FIG. 1 is a partially sectioned side view of a vertical package with a cardboard strip embracing six beer bottles, in which a cooling-medium receptacle is inserted.
Figure 2:
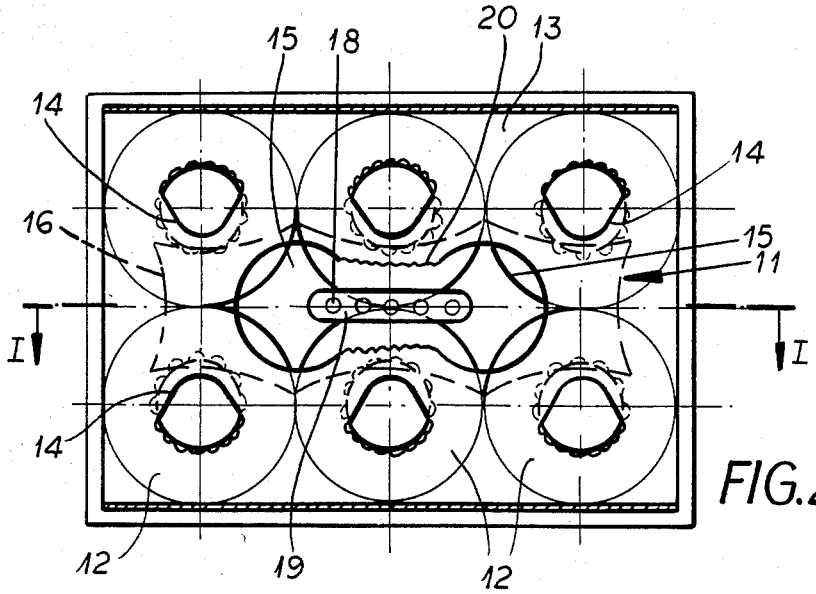
FIG. 2 is a partial sectional top view of the vertical package of FIG. 1.

In the examples shown in FIGS. 1 and 2, the departure point is a commonly known vertical package 11 for six beer bottles 12 which are surrounded and held together by a cardboard holder 13, whereby the crowncorks of the beer bottles are inserted into the corresponding cutouts 14 in the upper portion of the cardboard holder 13 and engage therein. In the commonly known manner, the cardboard holder 13 is provided in its upper portion 2 with openings 15, serving as handles.

In such a vertical package a cooling-medium receptacle 16 is inserted in the upper portion between the necks of the bottles 12, said recptacle being shaped like a bag with flexible circumference, while the cover portion 17 of this bag-shaped cooling-medium receptacle 16 can be reinforced or rigid. The flexible circumferential wall can be, for instance, made of aluminum foil coated with a synthetic material, while the cover wall can be made of two outer layers of such an aluminum foil with a cardboard strip in between. The cover wall 17 is trough-shaped in its median area and has there a group of holes 18, which together form a sieve-like inlet for feeding the liquid into the bag-shaped cooling-medium receptacle 16. The set of holes 18 is covered by a self-adhesive plastic strip 19.

The solid components of a cooling mix are filled in advance in the bag-shaped cooling-mix receptacle 16. The upright package 11 provided with the cooling-medium receptacle 16 filled with the solid components of the cooling mix is commercially available to the user. If the user desires to cool the beer before drinking, he can remove the portion of the cardboard holder 13 located between the handle openings 15 as shown in FIG. 2 at 20. Then the self-adhesive plastic strip 19 is removed from the cover wall 17 of the cooling-medium receptacle 16 and the water is poured into the cooling-medium receptacle through the holes 18. When the cooling-medium receptacle 16 is filled, the surface of the cover wall 17 is wiped dry and the self-adhesive plastic strip 19 is again pasted over the holes 18. The beverage can be cooled effectively with the cooling device activated in this manner and kept cool for an hour or longer, depending on the outside temperature. If a longer cooling time is desired, the vertical package 11 can be placed, after the activation of the cooling device, in a thermoinsulating container 21, for instance a container 21 of plastic foam, whose container cover 22 is removable at any time permitting the individual removal of the beer bottle 12 from the package while the cooling-medium receptacle 16 stays in contact with the remaining beer bottles 12.

Figure 3:
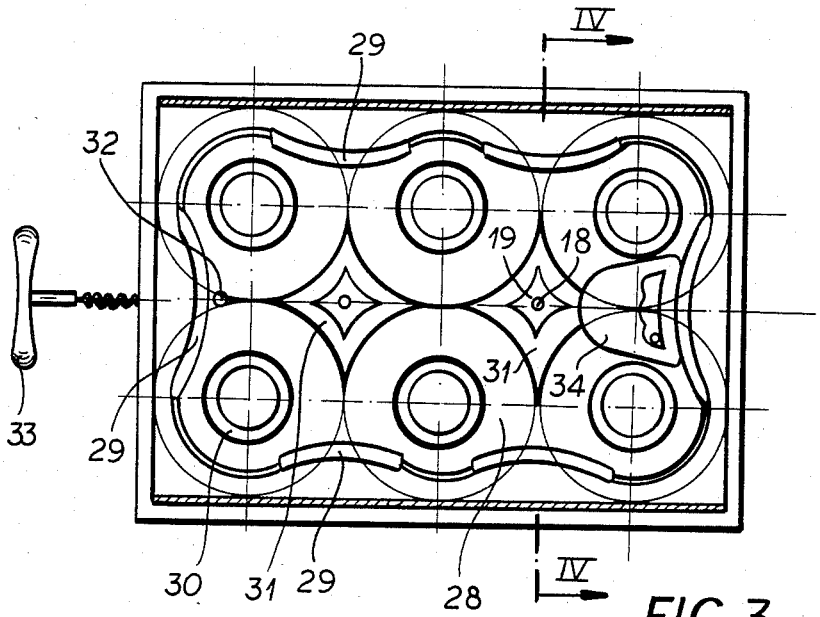
FIG. 3 shows a vertical package similar to those in FIGS. 1 and 2, with an additional locking plate in a partially sectioned top view.
Figure 4:
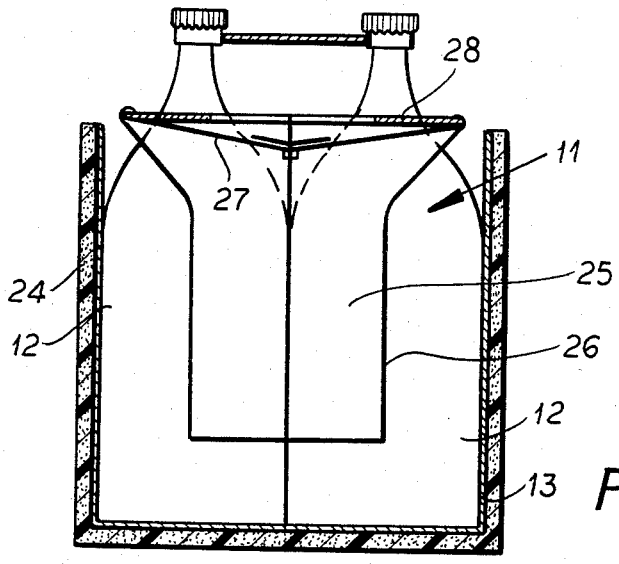
FIG. 4 shows the vertical package in a section along the line 4—4 of FIG. 3.

In the examples of FIGS. 3 and 4 the departure point is a similar vertical package 11 with six beer bottles 12 held together by a cardboard holder 13. A cooling-medium receptacle 25 is provided which consists of a peripheral wall 26 as well as a cover wall 27 both made of flexible material, for instance aluminum foil coated with plastic. In addition, this cooling-medium receptacle 25 has a locking plate 28 to which marginal areas 29 of the peripheral wall 26 and the cover wall 27 are attached in such a way—as shown in FIG. 4—that the actual bag-like receptacle is suspended under the locking plate 28. The locking plate 28 has six perforations 30 arranged in such a way as to allow the locking plate 28 to be positioned simultaneously with these perforations 30 over the necks of the six beverage bottles. The locking plate is rigid, made for instance of plastic material and secures thereby the contact between the beverage bottles held together by the vertical package and the cooling-medium receptacle 25. In order to keep in place the locking plate 28 with the actual bag-shaped container mounted thereto even during the activation of the cooling device, said plate has two openings 31 leading to the water-feed openings 18 located on the cover wall 27 and to the self-adhesive plastic strips 19 covering said openings. In addition, the locking plate 28 can have an opening 32 through which a corkscrew can be inserted. Furthermore, the locking plate 28 can carry a bottle opener 34.

In the embodiment according to FIGS. 3 and 4, the package can be used in many ways. For instance, the entire vertical package 11 as shown in FIGS. 1 and 2 can be inserted together with the cardboard holder 13 surrounding the bottles into a thermoinsulating container 21 as in FIGS. 1 and 2. But since the locking plate 28 ensures an essentially improved contact between the bottles 12 to be cooled and the cooling-medium receptacle 25, it is possible to eliminate the cardboard holder 13 entirely or its upper portion, before placing the vertical package 11 in a thermoinsulating container 24, as shown in FIGS. 3 and 4. It is also possible to use the container 24 instead of the package, by inserting the individual bottles 12 in this thermoinsulating container 24 and then by covering them with the locking plate 28 and the bag-shaped receptacle attached underneath, whereby the bag-shaped receptacle is placed between the bottles. It is also possible to provide an upright package 11 with already inserted cooling-medium receptacle 25 and pertaining locking plate 28 as a commerically available beverage package. Finally, it is also possible to cover groups of free-standing bottles 12 with the locking plate 28 and the actual bag-shaped receptacle and to cool this way free-standing groups of bottles 12.

Figure 6:
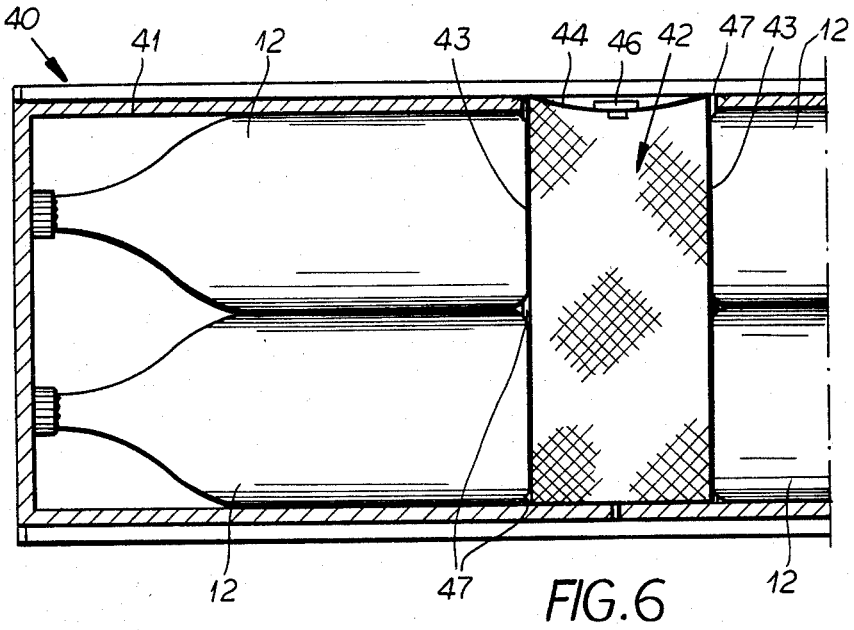
FIG. 6 is a section along line 6—6 of FIG. 5.
Figure 5:
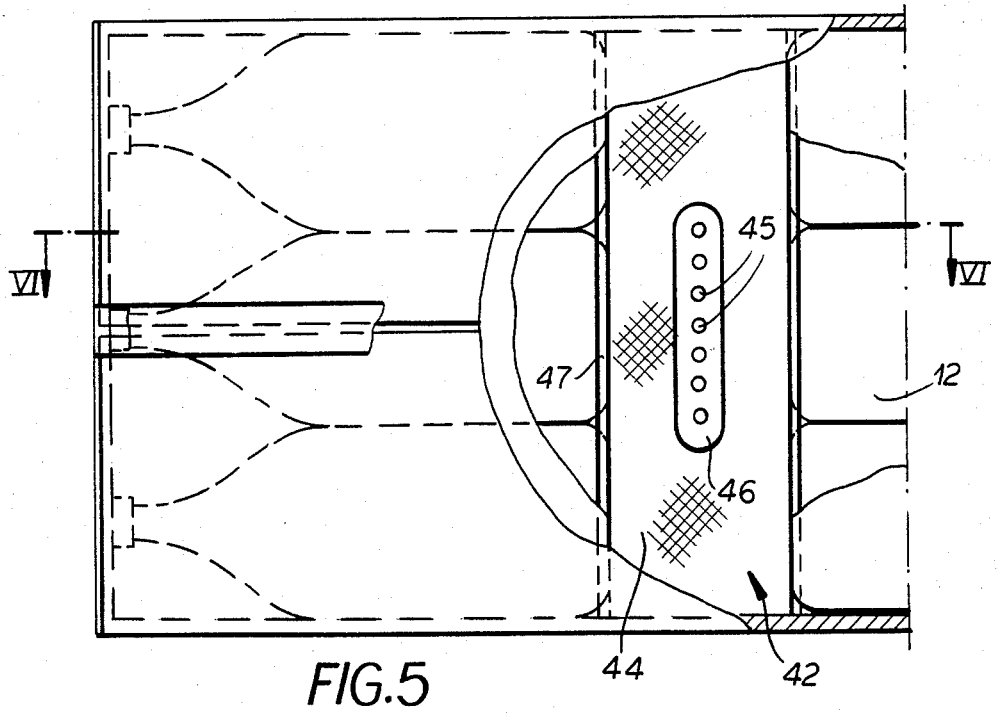
FIG. 5 is a partially sectioned top view of a compact package of six beverage bottles and the cooling device according to the invention.

The embodiment of FIGS. 5 and 6 is a compact cardboard package 40 for twelve beverage bottles 12. The beverage bottles 12 are located in a folding box 41 in two layered groups and directed with their bottle necks towards the ends of the box and with their bottle bottoms towards the middle of the box. In the middle of the box, a cooling-medium receptacle 42 is mounted between the bottoms of the beverage bottles 12 of both groups, so that the bottoms of the bottles are in contact with the lateral walls 43 of this cooling-medium receptacle 42. The cover wall 44 of the cooling-medium receptacle 42 is trough-shaped towards the center and has there a group of filling openings 45, covered and closed by a self-adhesive plastic strip 46. But is is also possible to make the cover wall 44 relatively rigid and to provide a closing strip 46 which engages with its plug-like elements in the feeding openings 45. At first, the cooling-medium receptacle is filled only with the amount of solid components of a cooling mix so that simply by the addition of water to the cooling-medium receptacle 42 a cooling mix of optimal composition results.

In order to ensure on the one hand a good surface contact between the beverage bottles 12 and the lateral walls 43 fo the cooling-medium receptacle 42 and on the other hand to provide the required stability of the entire package 40, at least the lateral walls 43, preferably the entire surrounding wall of the cooling-medium receptacle 42 are made of aluminum foil coated with plastic material. In addition, the cooling-medium receptacle 42 is surrounded by frames 47, supporting the bottles in the area of their bottom circumferences. Further stabilizing elements provided in the cardboard package 40 can be of the common kind and are not represented in the drawing for the sake of simplicity.

The cardboard package 40 shown in FIGS. 5 and 6 can be handled as a unit including the cooling-medium receptacle 42 it contains and is also transportable and shippable. If cooling of the beverage contained in the bottles 12 is desired before consumption, it is only required to open the cardboard package 40 at its top, whereby the cover wall 44 of the cooling-medium receptacle 42 with the feeding openings 45 and the covering elements 46 is exposed. It is further only required to temporarily remove the closing element 46 and to fill the cooling-medium receptacle 42 with water through its openings 45 working as a sieve and, after that, to reposition the closing element 46. After passing of a cooling period, for instance, half an hour it is possible to remove the beverage bottles 12 individually from the cardboard package 40. In the cardboard package 40 after cooling, the beverage can be kept cool for a certain period of time, for instance one or two hours.

Figure 7:
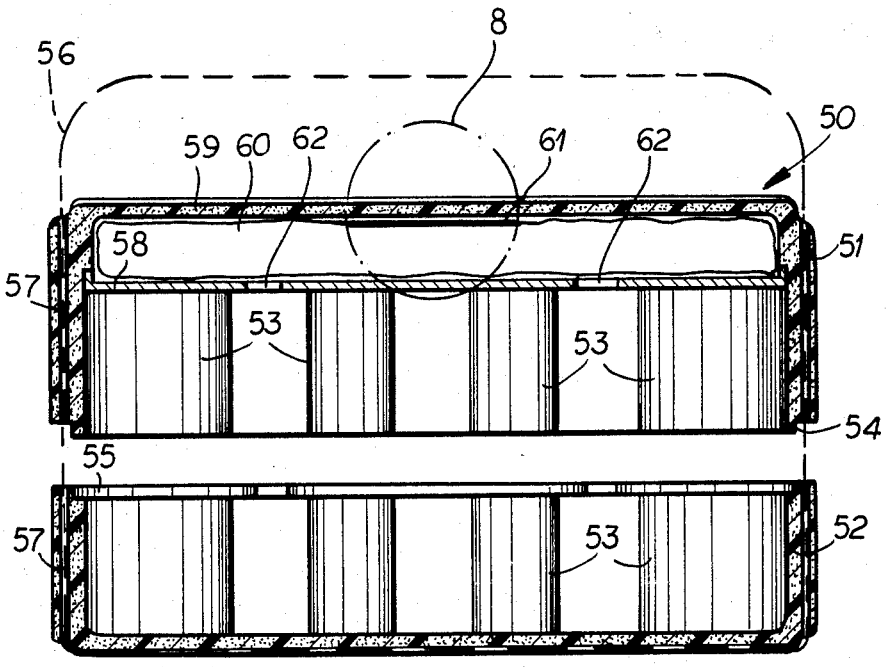
FIG. 7 shows a portable package for four beverage cans in vertical section.
Figure 8:
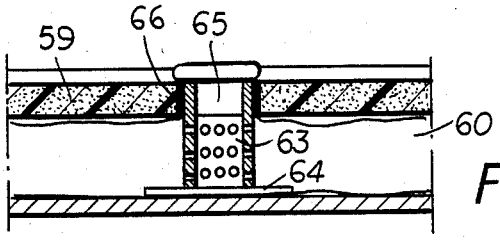
FIG. 8 shows the area 8 of FIG. 7 in a modified execution.

In the embodiment of the FIGS. 7 and 8 a portable package 50 for beverage cans is shown. This portable package has a package top 51 and a package bottom 52 made of plastic foam with plastic-material stiffeners added for increased stability. The inner space of the package top and the package bottom is provided with pocket-like spaces 53 to receive the cans to be inserted. The package top 51 and the package bottom 52 have interengaging connection ledges 54 and 55 at their opening rim, so that by assembling the package top 51 and the package bottom 52 a compactly closed and rigid package is created. In order to make the package portable, a carrying strap 56 is provided as marked in the drawing with a dotted line. This carrying strap 56 extends through lateral spaces 57 in the package top portion 51 and the package bottom portion 52.

In the package upper portion 51 an intermediate wall 58 covering the entire inner space and made of a heat-conducting material, for instance aluminum sheet, is mounted. The chamber created this way behind the cover 59 of the package top 51 serves to receive the cooling-medium receptacle 60, which can have the shape of a bag and be made of aluminum foil coated with plastic and carries a row of filling openings at its surface, which are covered and closed by a closing strip 61. In the cooling-medium receptacle 60, solid components of a cooling mix are filled in advance so that later, for the activation of the cooling mix, only water is to be added to the cooling-medium receptacle 60. In the embodiment of FIG. 7, the intermediate wall 58 provided with handle openings 62 has to be removed for this purpose from the package top 51. Further, the cooling-medium receptacle 60 has to be taken out, filled with water and closed again tightly and repositioned and after that, the intermediate wall 58 has to be reinserted. The portable package 50 according to FIG. 7 can be designed for multiple utilizations. It is recommended for this purpose to remove the cooling-medium receptacle 60 after the cooling mix is used up and to replace it with a freshly prepared cooling-medium receptacle. In order to avoid the necessity to remove the cooling-medium receptacle 60 from the package upper portion 51 for activation, a modofied embodiment according to FIG. 8 can be provided, wherein the cooling-medium receptacle 60 has a filling and straining tube 63 extending over the entire thickness of the bag, which can have for safety purposes a support plate 64 resting on the bottom wall of the cooling-medium receptacle 60. The cover wall of the cooling-medium receptacle 60 is liquid-tight with respect to the outer surface of the filling and straining tube 63 and tightly connected, for instance welded, thereto. A plug 65 is inserted in the opening of this filling and straining tube 63. This filling and straining tube 63 extends with its opening and the plug 65 through a perforation 66 in the cover wall 59 of the package upper portion 51. This way, the cooling mix in the cooling-medium receptacle 60 can be activated from the outside of the portable package 50. To remove the cooling-medium receptacle 60 after the cooling mix is used up, it is necessary to only take up the intermediate wall 51 and to insert a new cooling-medium receptacle, which after the introduction of the beverage cans in the portable package 50 can be reactivated from the outside at any desired time.

In order to create the possibility for more intensive cooling, the package bottom 52 can be built in the same manner as the package upper portion 51, correspondingly higher and with an intermediate wall 58 creating a chamber to receive a cooling-medium receptacle 60.

Inasmuch as numbers are given in the afore-mentioned embodiments with respect to the containers to be cooled and arranged in groups, these numbers are only to be considered as examples. For instance, a support container 24 according to FIGS. 3 and 4 can be built to accommodate four bottles, whereby the locking plate 28 and the cooling-medium receptacle 25 are also built for four bottles.

I claim:

1. A self-cooling package assembly for a multiplicity of beverage containers, comprising:

a multiplicity of beverage containers arranged in an array;

a wrapping at least partly enclosing said containers and extending around said array to retain said containers together in said array; and a tightly closable cooling medium receptacle received in said wrapping, said receptacle including:

thermally conductive walls defining an interior compartment of said receptacle and in contact with said containers for cooling same upon the generation of a refrigerating reaction in said compartment, means forming an inlet communicating with said compartment for adding a reactive component thereto adapted to react to form a refrigerating mixture in said compartment, a durable storage-stable reactive component retained in said compartment under noncooling conditions and adapted to react with said reactive component added through said inlet to generate a cooling mixture abstracting heat from said containers through said walls, and means for closing said inlet to retain said mixture in said compartment.

2. A self-cooling package assembly defined in claim 1 wherein said containers have necks and said receptacle is shaped to fit in a space among said necks within said wrapping.

3. The self-cooling package assembly defined in claim 1 wherein said receptacle is formed with a rigid cover wall provided with said inlet and said thermally conductive walls are flexible.

4. The self-cooling package assembly defined in claim 1 wherein said wrapping includes a tearable section adapted to expose said inlet.

5. The self-cooling package assembly defined in claim 3 wherein said means for closing said inlet includes an adhesive strip.

6. The self-cooling package assembly defined in claim 1 wherein said receptacle has a rigid plate formed with recesses fitting around necks of said containers.

7. The self-cooling package assembly defined in claim 1 wherein said receptacle has a trough-shaped cover portion formed with said inlet.

8. The self-cooling package assembly defined in claim 1 wherein said inlet includes a plurality of openings defining a screen preventing contaminants from entering said compartment.

9. The self-cooling package assembly defined in claim 1 wherein said receptacle contacts bottoms of said containers within said wrapping.

10. The self-cooling package assembly defined in claim 1 wherein said receptacle has a configuration of a bag.

11. The self-cooling package assembly defined in claim 1 wherein said assembly further comprises an insulating enclosure surrounding said containers, said wrapping and said receptacle.

* * * * *